US008983819B2

(12) United States Patent
Jiang et al.

(10) Patent No.: US 8,983,819 B2
(45) Date of Patent: Mar. 17, 2015

(54) SYSTEM, METHOD AND COMPUTER PROGRAM PRODUCT TO SIMULATE RUPTURE DISK AND SYNTACTIC FOAM TRAPPED ANNULAR PRESSURE MITIGATION IN DOWNHOLE ENVIRONMENTS

(75) Inventors: Jun Jiang, Austin, TX (US); Max Orland Duncan, Humble, TX (US); Robert Franklin Mitchell, Houston, TX (US); Adolfo Camilo Gonzales, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 393 days.

(21) Appl. No.: 13/546,777

(22) Filed: Jul. 11, 2012

(65) Prior Publication Data

US 2014/0019107 A1 Jan. 16, 2014

(51) Int. Cl.
*G06G 7/48* (2006.01)
*E21B 43/12* (2006.01)
*E21B 21/08* (2006.01)

(52) U.S. Cl.
CPC ..... *E21B 43/12* (2013.01); *E21B 21/08* (2013.01)
USPC ..... 703/10; 703/6

(58) Field of Classification Search
CPC ..... E21B 34/10; E21B 29/06; E21B 33/12; E21B 19/00; E21B 34/06; E21B 29/00; E21B 23/06; E21B 33/13; E21B 47/06; E21B 43/04; E21B 43/00; E21B 17/10; E21B 33/126; E21B 33/14; E21B 33/127; E21B 34/14; E21B 47/00; E21B 29/08; E21B 33/124; E21B 23/00; E21B 23/04; E21B 43/12; E21B 28/00; F04C 2/107; G01V 1/00
USPC ..... 166/376, 373, 387, 90.1, 52, 14, 166/250.07, 87.1, 369, 187; 175/5
See application file for complete search history.

(56) References Cited

U.S. PATENT DOCUMENTS

| | | | | |
|---|---|---|---|---|
| 5,526,878 | A * | 6/1996 | Duell et al. | 166/187 |
| 5,819,853 | A * | 10/1998 | Patel | 166/373 |
| 2003/0034156 | A1* | 2/2003 | Gondouin | 166/52 |
| 2004/0114463 | A1* | 6/2004 | Berg et al. | 367/14 |
| 2007/0246227 | A1* | 10/2007 | Ezell et al. | 166/387 |
| 2008/0156498 | A1* | 7/2008 | Phi et al. | 166/376 |
| 2009/0229832 | A1* | 9/2009 | King | 166/373 |
| 2009/0236144 | A1* | 9/2009 | Todd et al. | 175/5 |
| 2009/0250226 | A1* | 10/2009 | Al-Anazi | 166/376 |
| 2009/0301730 | A1* | 12/2009 | Gweily | 166/369 |
| 2010/0108326 | A1* | 5/2010 | Messick et al. | 166/373 |
| 2011/0017448 | A1* | 1/2011 | Pipchuk et al. | 166/250.07 |
| 2011/0036560 | A1* | 2/2011 | Vail et al. | 166/87.1 |
| 2011/0284209 | A1* | 11/2011 | Carpenter et al. | 166/90.1 |
| 2011/0315405 | A1* | 12/2011 | Solhaug et al. | 166/387 |

OTHER PUBLICATIONS

Osman, R.H., "Water hammer analysis of pipeline system", Keg92.org, 1992.*

* cited by examiner

*Primary Examiner* — Kandasamy Thangavelu

(57) ABSTRACT

Systems and related methods to simulate the use of rupture disks and syntactic foam in the mitigation of trapped annular pressure and wellhead movement during downhole operations.

24 Claims, 5 Drawing Sheets

Fig. 5

500

| MultiString Annular Fluid Expansion Summary | | | | |
|---|---|---|---|---|
| | String Annulus | Region | Incremental AFE Pressure (1) (psi) | Incremental AFE Volume (2) (bbl) |
| 1 | 16" Surface Liner | Region 1 | 706.00 | 16.7 |
| 2 | 13 5/8" Intermediate Casing | Region 1 | 23.00 | 29.7 |
| 3 | 9 5/8" Protective Casing | Region 1 | 0.00 | 28.1 |
| 4 | 7" Production Casing | Region 1 | 1371.00 | 15.1 |
| 5 | 4 1/2" Production Tubing | Region 1 | 0.00 | 11.3 |
| 6 | 4 1/2" Production Tubing | Region 2 | 2280.0 | 0.2 |
| 7 | 4 1/2" Production Tubing | Region 3 | 650.0 | 0.1 |
| 8 | | | | |
| 9 | (1) Pressure change caused solely by the Annular Fluid Expansion (AFE) phenomenon | | | |
| 10 | (2) Volume change caused solely by the Annular Fluid Expansion (AFE) effect | | | |

| MultiString Wellhead Movement Displacement Summary | | | |
|---|---|---|---|
| | Load | Displacement | |
| | | Incremental (ft) | Cumulative (ft) |
| 1 | Primary Cementing - 16in Surface Casing | 0.00 | 0.00 |
| 2 | Primary Cementing - 13 5/8in Intermediate Casing | -0.09 | -0.09 |
| 3 | Primary Cementing - 9 5/8in Protective Casing | -0.08 | -0.17 |
| 4 | Primary Cementing - 7in Production Casing | -0.05 | -0.22 |
| 5 | Primary Cementing - 4 1/2in Production Tubing | -0.03 | -0.25 |
| 6 | Long Term Production Oil Gas - 4 1/2in Production Tubing | 0.56 | 0.30 |

SYSTEM, METHOD AND COMPUTER PROGRAM PRODUCT TO SIMULATE RUPTURE DISK AND SYNTACTIC FOAM TRAPPED ANNULAR PRESSURE MITIGATION IN DOWNHOLE ENVIRONMENTS

FIELD OF THE INVENTION

The present invention generally relates to downhole simulators and, more specifically, to a system to determine the annular pressure buildup along a wellbore in response to the presence of a rupture disk and/or syntactic foam.

BACKGROUND

The existence of trapped annular pressure and wellhead movement caused by production temperatures is known in the industry. Traditionally, mitigation techniques have been limited to the analysis of the presence of gas cap, leak off, volume bleed, and annular venting conditions. Although rupture disks and syntactic foam are known in the industry, there exists no means to analyze the effects that such mitigation techniques have on the annular pressure buildup or final system pressure equilibrium of the wellbore.

Accordingly, in view of the foregoing shortcomings, there is a need in the art for a systematic analysis that predicts and/or determines the effect that the use of rupture disks and syntactic foam would have on trapped annular pressure and wellhead movement.

BRIEF DESCRIPTION OF THE DRAWINGS

FIG. 5 is a screen shot illustrating an annular fluid expansion summary utilizing an exemplary embodiment of the present invention.

DESCRIPTION OF ILLUSTRATIVE EMBODIMENTS

Illustrative embodiments and related methodologies of the present invention are described below as they might be employed in a system for analyzing the effects of mitigation techniques on trapped annular pressure and wellhead movement in downhole environments. In the interest of clarity, not all features of an actual implementation or methodology are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
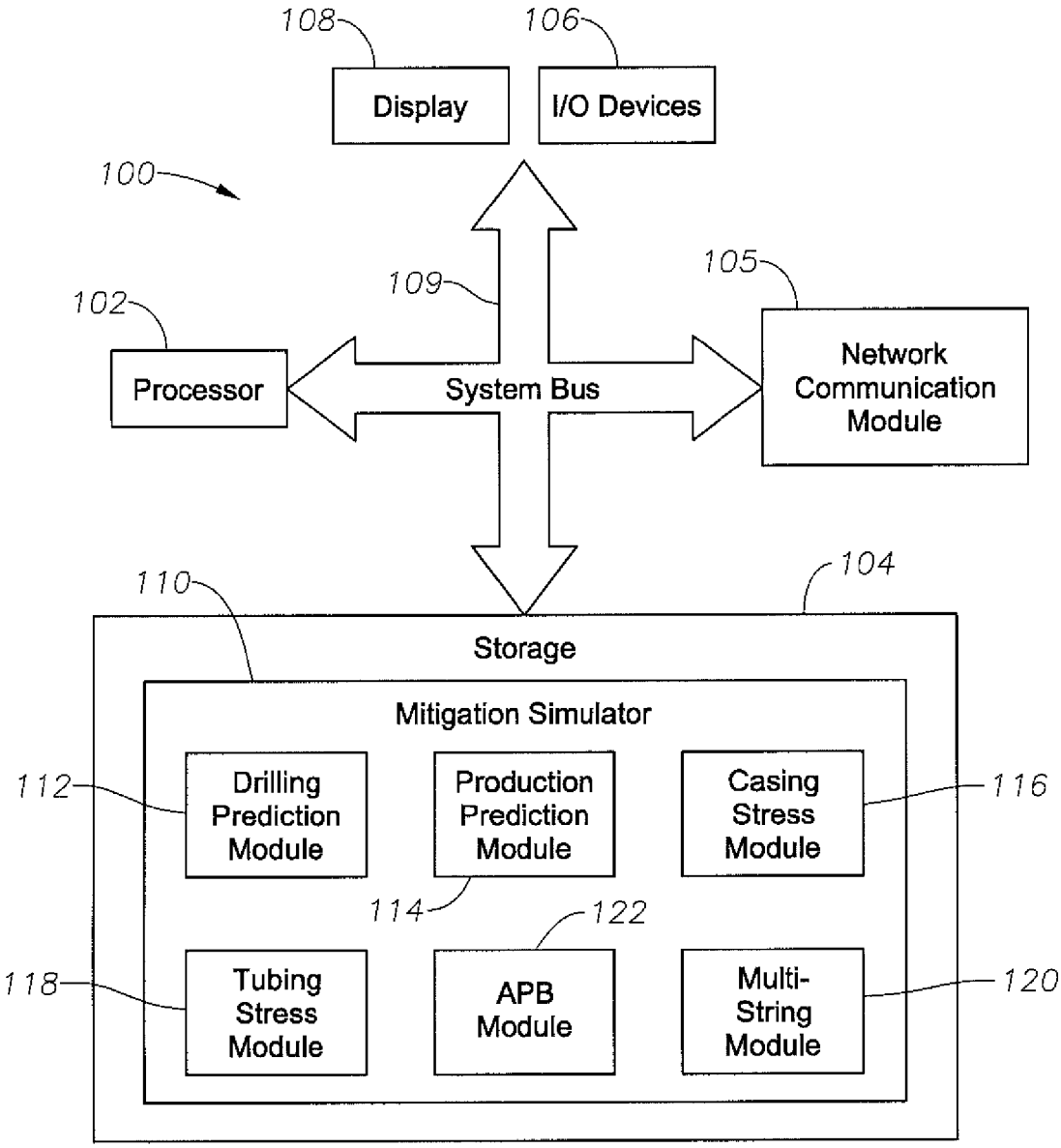
FIG. 1 illustrates a block diagram of a downhole mitigation system according to an exemplary embodiment of the present invention.

FIG. 1 shows a block diagram of downhole mitigation system 100 according to an exemplary embodiment of the present invention. In one embodiment, downhole mitigation system 100 includes at least one processor 102, a non-transitory, computer-readable storage 104, transceiver/network communication module 105, optional I/O devices 106, and an optional display 108, all interconnected via a system bus 109. Software instructions executable by the processor 102 for implementing software instructions stored within mitigation simulator 110 in accordance with the exemplary embodiments described herein, may be stored in storage 104 or some other computer-readable medium.

Although not explicitly shown in FIG. 1, it will be recognized that downhole mitigation system 100 may be connected to one or more public and/or private networks via appropriate network connections. It will also be recognized that the software instructions comprising mitigation simulator 110 may also be loaded into storage 104 from a CD-ROM or other appropriate storage media via wired or wireless means.

FIG. 1 further illustrates a block diagram of mitigation simulator 110 according to an exemplary embodiment of the present invention. As will be described below, mitigation simulator 110 comprises drilling prediction module 112, production prediction module 114, casing stress module 116, tubing stress module 118, multi-string module 120, and an annular pressure buildup ("APB") module 122. Based upon the input variables as described below, the algorithms of the various modules combine to formulate the downhole mitigation analysis of the present invention.

Drilling prediction module 112 simulates, or models, drilling events and the associated well characteristics such as the drilling temperature and pressure conditions present downhole during logging, trip pipe, casing, and cementing operations. Production prediction module 114 models production events and the associated well characteristics such as the production temperature and pressure conditions present downhole during circulation, production, injection, gas lift and shut in operations. Casing stress module 116 models the stresses caused by changes from the initial to final loads on the casing, as well as the temperature and pressure conditions affecting the casing.

Tubing stress module 118 simulates the stresses caused by changes from the initial to final loads on the tubing, as well as the temperature and pressure conditions affecting the tubing. The modeled data received from the foregoing modules is then fed into multi-string module 120 which analyzes and then models the annular fluid expansion and wellhead movement present in a system defined by the original input variables. Thereafter, the data modeled in multi-string module 120 is then fed into APB module 122, which models the annular fluid expansion and wellhead movement in light of defined mitigation techniques that provide additional volume for the fluid to expand without increasing pressure. Persons ordinarily skilled in the art having the benefit of this disclosure realize there are a variety modeling algorithms that could be employed to achieve the results of the foregoing modules.

Figure 2:
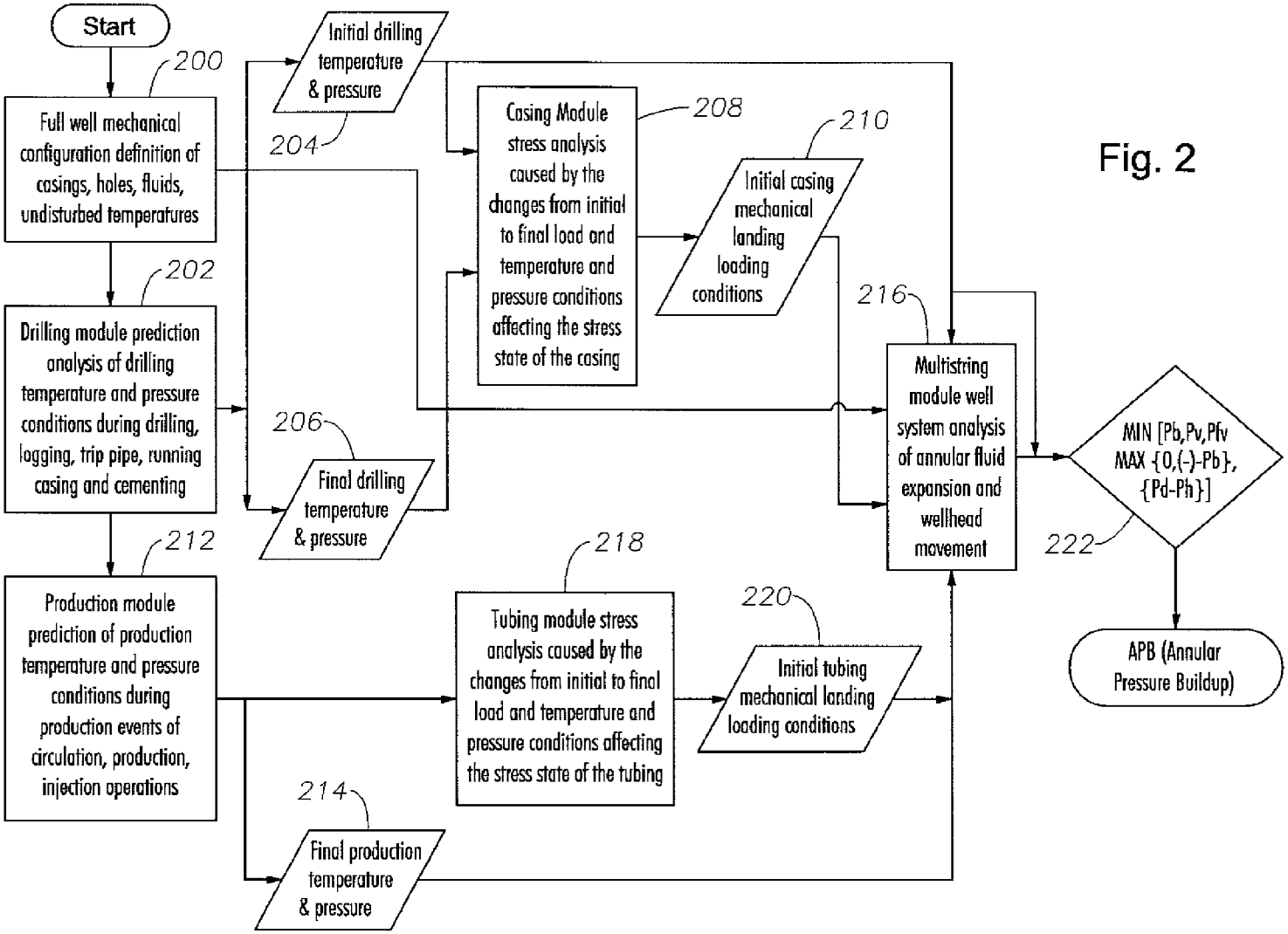
FIG. 2 is a flow chart illustrating data flow associated with an exemplary methodology of the present invention.

FIG. 2 illustrates the data flow of downhole simulation system 100 according to an exemplary methodology of the present invention. At step 200, the mechanical configuration of the well is defined using manual or automated means. For example, a user may input the well variables via I/O device 106 and display 108. However, the variables may also be received via network communication module 105 or called from memory by processor 102. In this exemplary embodiment, the input variables define the well configuration such as, for example, number of strings, casing and hole dimensions, fluids behind each string, cement types, and undisturbed static downhole temperatures. As will be described later, this configuration data also defines characteristics of rupture disks and/or syntactic foam used for mitigation. Based upon these input variables, at step 202, using drilling prediction module 112, processor 102 models the temperature and pressure conditions present during drilling, logging, trip pipe, casing, and cementing operations. At step 204, processor 102 then outputs the initial drilling temperature and pressure of the wellbore.

Further referring to FIG. 2, at step 206, processor 102 outputs the "final" drilling temperature and pressure. Here, "final" can also refer to the current drilling temperature and pressure of the wellbore if the present invention is being utilized to analyze the wellbore in real time. If this is the case, the "final" temperature and pressure will be the current temperature and pressure of the wellbore during that particular stage of downhole operation sought to be simulated. Moreover, the present invention could be utilized to model a certain stage of the drilling or other operation. If so, the selected operational stage would dictate the "final" temperature and pressure.

The initial and final drilling temperature and pressure values are then fed into casing stress module 116, where processor 102 simulates the stresses on the casing strings caused by changes from the initial to final loads, as well as the temperature and pressure conditions affecting those casing strings, at step 208. At step 210, processor 102 then outputs the initial casing mechanical landing loading conditions to multi-string module 120 (step 216), Referring back to step 200, the inputted well configuration data may also be fed directly to multi-string module 120 (step 216). In addition, back at step 204, the initial drilling temperature and pressure data can be fed directly into multi-string module 120 (step 216).

Still referring to the exemplary methodology of FIG. 2, back at step 202, processor 102 has modeled the drilling temperature and pressure conditions present during drilling, logging, trip pipe, casing, and cementing operations. Thereafter, at step 212, these variables are fed into production prediction module 114, where processor 102 simulates production temperature and pressure conditions during operations such as circulation, production, and injection operations. At step 214, processor determines the final production temperature and pressure based upon the analysis at step 212, and this data is then fed into multi-string module 120 at step 216.

Referring back to step 212, after the production temperature and pressure conditions have been modeled, the data is fed into tubing stress module 118 at step 226. Here, processor 102 simulates the tubing stresses caused by changes from the initial to final loads, as well as the temperature and pressure conditions affecting the stress state of the tubing. Thereafter, at step 220, processor 102 outputs the initial tubing mechanical landing loading conditions, and this data is fed into multi-string module 120 (step 216). At step 216, now that all necessary data has been fed into multi-string module 120, the final (or most current) well system analysis and simulation is performed by processor 102 in order to determine the annular fluid expansion (i.e., trapped annular pressures) and wellhead movement.

Thereafter, at step 222, processor 102 performs an APB analysis of the wellbore (using APB module 122) as defined by the data received from multi-string module 120. Here, taking into account defined rupture disk and syntactic foam data, APB module 122 will analyze and simulate the annular fluid expansion (i.e., trapped annular pressure) and wellbore movement over the life of the defined wellbore. In doing so, processor 102 will calculate a final APB for the wellbore that will be defined by the minimum of the initial calculated pressure buildup ("Pb"), annular vented pressure ("Pv"), syntactic foam volume ("Pfv"), and the maximum of differential Pleak (Pl−Ph) and Pdisk (Pd−Ph), as described below. Thereafter, at step 224, processor 102 outputs the final APB. Accordingly, the methodology illustrated in FIG. 2 may be used to simulate well designs according to desired mitigation techniques, even in real-time through linkage of final thermal operating conditions to the desired downhole event.

Figure 3:
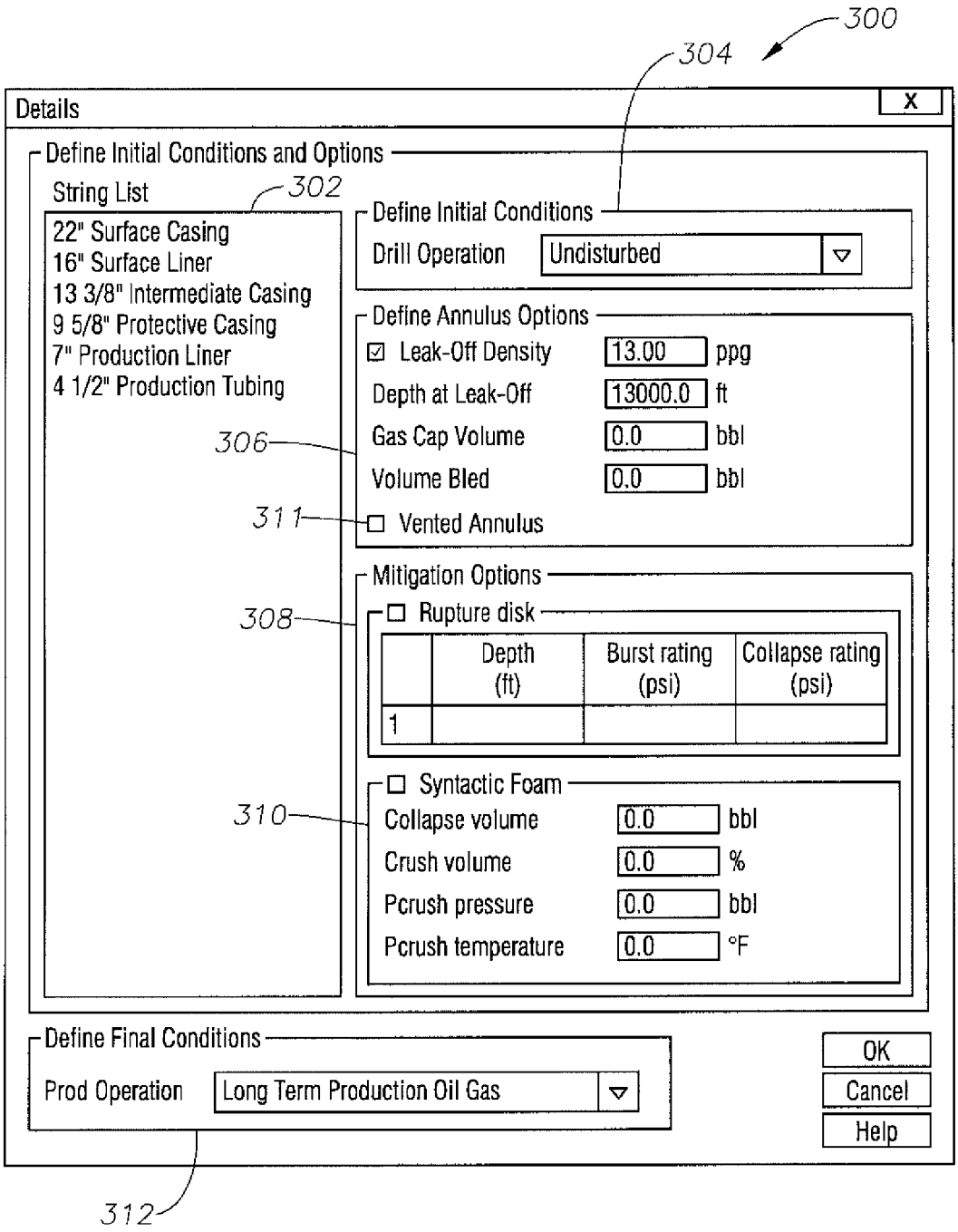
FIG. 3 is a screen shot of an interface having various wellbore configuration windows according to an exemplary embodiment of the present invention.

FIG. 3 illustrates a user interface 300 utilized to defined wellbore characteristics and mitigation data according to an exemplary embodiment of the present invention. At step 200, user interface 300 is displayed on display 108. In window 302, a list of user-specified string characteristics are displayed. Windows 304 and 306 are used to define initial conditions and annulus options, respectively. In window 308, the mitigation options can be defined to include any number of rupture disks per string and their respective depths, burst ratings, and collapse ratings. In window 310, the well configuration can be defined to include a specified collapse volume of syntactic foam, crush volume percentage, Pcrush pressure, and Pcrush temperature. Syntactic foams belongs to a class of material known as cellular solids, and they are characterized by internal porous structure. The pore spaces usually are reinforced with glass or carbon fiber glass beads. The behavior of syntactic foam is determined principally by its crush pressure, Pcrush. Pcrush, or crush pressure, is the hydrostatic pressure that causes the foam modules to crush catastrophically until all the pore spaces either have collapse or are filled with the invading fluid. When this happens, crushes cease.

A vented or unvented annulus 311 may also be defined. Lastly, window 312 allows definition of the final conditions such as, for example, a production operation and a corresponding time period. After the well configuration data has been defined via interface 300, downhole simulation system 100 simulates the effects that the defined rupture disks and syntactic foam would have on the APB over the specified life of the well.

As described above, the present invention allows definition of annular fluid expansion mitigation techniques that provide additional volume for fluid to expand without increasing pressure. In exemplary embodiments of the present invention, rupture disks and syntactic foam are utilized as the mitigation mechanisms. By placing a sufficient volume of crushable syntactic foam in the annulus during subsequent well operations (e.g., production), additional volume is provided to allow the fluid to expand without increasing pressure. As the pressure increases downhole, the syntactic foam would crush, thereby providing additional volume. Rupture disks provide outer and inner wall casing protection, as they can be designed to fail upon a specified internal or external pressure, or at a given temperature.

A summary description of the mathematical logic utilized by mitigation simulator 110 will now be briefly described, as persons ordinarily skilled in the art having the benefit of this disclosure would readily understand. In the fluid expansion modeling of the present invention, the two primary factors affecting heat up pressures are the thermal expansion of confined annular fluids and the radial or axial movement of the enclosing casings. These effects are coupled through pressure and must be solved simultaneously. The thermal fluid expansion for a given annulus may be determined as follows:

Assuming that vertical dimensions are fixed, conservation of mass requires:

$$Mf=\int \rho f A dz=\int (pf+\Delta pf)(A+\Delta A)dz, \quad \text{Equation (1):}$$

where Mf is the fixed annular fluid mass, pf is the fluid density, A is the annular cross-sectional area, and Δ denotes the change from the initial to the final state. Initial densities are evaluated at setting pressures and temperatures, and final densities are evaluated at the operating conditions including heat pressures.

The net fluid volume change can then be determined as follows:

$$\Delta Vf=\int \Delta A dz=\int A\Delta pf/(pf+\Delta pf)dz \quad \text{Equation (2):}$$

After the casings are set, they are subjected to various types of incremental loads that result from changes in applied loads or wellbore pressures and temperatures. These load changes result in interactive string movements that cause the enclosed annular spaces to vary in volume. For a given annulus, the net volume change is computed by numerically integrating volume changes caused by the elastic deformation of the confining casing/tubing strings as follows:

$$\Delta Va=\pi\int[(\Delta ro^2+2\Delta roro)-(\Delta ri^2+2\Delta riri)]dz+\Delta Vz, \quad \text{Equation (3):}$$

where ri is the inside radius of the annulus (i.e., the outside radius of the inner casing or tubing); ro is the outside radius of the annulus (i.e., the inside radius of the outer casing); Δri and Δro refer to the incremental radial displacements at r=ri, and ro, respectively; and ΔVz is the volume change resulting from the change in annulus axial dimensions. A volume residual is then defined as follows:

$$Vr=\Delta Vf-\Delta Va, \quad \text{Equation (4):}$$

where the pressure build up pbu is found until the Vr=zero.

Once leakoff pressure, pl, annular vent pressure, pv, rupture disk pressure, pd, and syntactic foam volume, Pfv, are specified, then:

$$\text{Pressure build up } (Pbu)=\min[pb,pv,pfv,\max(0,(pl-ph),(pd-ph))],$$

where ph is the hydrostatic pressure at leakoff depth.

Utilizing APB module 122, processor 102 repeats this analysis for each sealed annulus. As a result, downhole simulation system 100 then determines the final APB along the wellbore, which will be the minimum of the Pb, Pv, Pfv, and the maximum of differential Pleak and Pdisk. Once multi-string equilibrium is attained, global well convergence is reached. As such, the present invention may also include a progressive failure analysis of rupture disk failure(s) in a multiple rupture disk per string scenario until the pressure system equilibrates.

Figure 4:
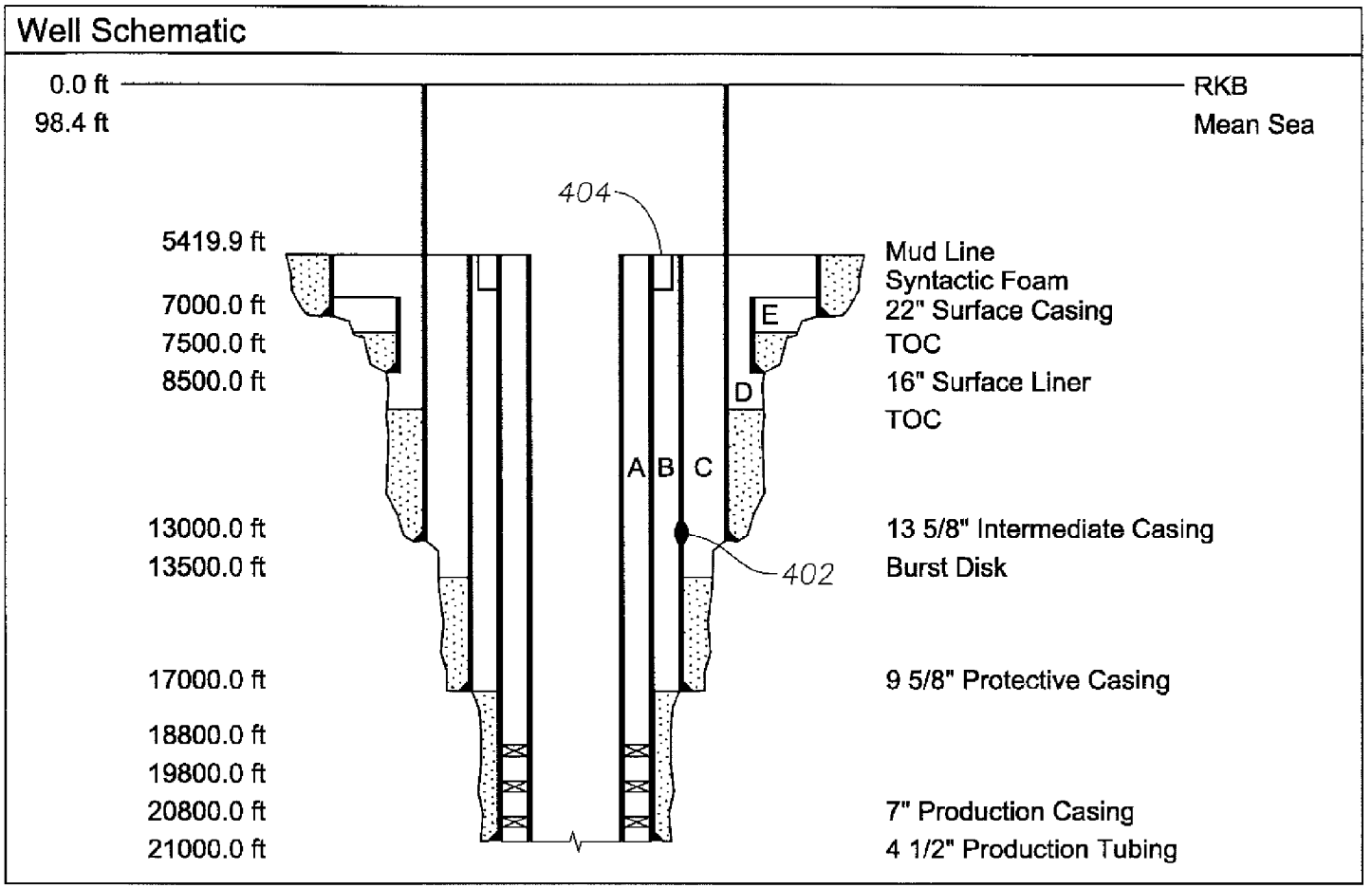
FIG. 4 is a screen shot illustrating a Wellbore configuration according to an exemplary embodiment of the present invention.

FIG. 4 illustrates a screen shot 400 showing a well schematic displayed utilizing an exemplary embodiment of the present invention. The well configuration includes four annulus; A, B, C, D and E. Annulus A is expected to be vented to surface, while Annuli C, D and F are exposed to uncemented open holes, leaked to formation. Rupture disk(s) 402 has been installed in 9⅝" protective casing with a designed burst disk rating to induce a fluids bled path from Annulus B to Annulus C, and eventually to leak to the formation. Also, in the event of a rupture disk collapse scenario (due to a rupture disk burst rating malfunction and annulus C pressures in excess to hydrostatic not leaking into formation), a volume of syntactic foam (designated by 404) by design has been installed along the 7" production casing length to provide additional fluid volume pressure relief. In this exemplary embodiment, schematic 400 is presented in display 108, showing the mitigation options applied to the analysis.

FIG. 5 illustrates a screen shot of the fluid expansion summary produced using exemplary embodiments of the present invention. After step 222, once the analysis of mitigation system 100 is complete, fluid expansion summary 500 may be displayed via display 108. As shown, each defined string annulus, its location, and corresponding pressures and volumes are detailed. In addition, a wellhead movement displacement summary is also included.

Although rupture disks and syntactic foam are described herein as mitigation options, those ordinarily skilled in the art having the benefit of this disclosure realize there are other mitigation options that could be simulated within the present invention, and this disclosure is meant to encompass those additional options as well. For example, other traditional mitigation options, such as annular vented (Annulus A as described in FIG. 4), leak-off (FIG. 4, Annulus C, D, and E), as well as Gas cap volume and amount of volume bled (FIG. 3) can be applied in combination with the rupture disk and syntactic foam to manage final trapped annuli pressure utilizing embodiments of the present invention.

Accordingly, exemplary embodiments of the present invention may be utilized to conduct a total well system analysis during the design phase or in real-time. It can also be used to analyze the influence that rupture disks and syntactic foam has on the thermal expansion of annulus fluids, and/or the influence of loads imparted on the wellhead during the life of the well, as well as the load effects on the integrity of a well's tubulars. Accordingly, the load pressures and associated wellhead displacement values are used to determine the integrity of a defined set of well tubulars in the completed well or during drilling operations.

Although various embodiments and methodologies have been shown and described, the invention is not limited to such embodiments and methodologies and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What we claim is:

1. A computer-implemented method to determine annular pressure buildup along a well bore, the method comprising:

(a) analyzing, using a computer, a configuration of the wellbore;

(b) analyzing, using the computer, an effect that at least one of a rupture disk or syntactic foam has on the wellbore; and (c) determining, using the computer, the annular pressure buildup along the wellbore based upon the analysis of step (b).

2. A computer-implemented method as defined in claim 1, wherein step (b) further comprises analyzing the effect that the at least one of the rupture disk or syntactic foam has on a trapped annular pressure or wellhead movement of the wellbore.

3. A computer-implemented method as defined in claim 1, wherein step (a) further comprises:

determining an initial temperature and pressure condition of the wellbore; and determining a final temperature and pressure condition of the wellbore.

4. A computer-implemented method as defined in claim 1, wherein step (a) further comprises analyzing at least one of a drilling temperature or pressure, a production temperature or pressure, a casing stress, or a tubular stress present along the wellbore.

5. A computer-implemented method as defined in claim 1, wherein step (a) further comprises receiving data via a user-interface, the data defining the configuration of the wellbore.

6. A computer-implemented method as defined in claim 5, wherein the data defining the configuration of the wellbore comprises at least one of a number of the rupture disks, a burst rating of the rupture disks, a collapse volume of the syntactic foam, or a crush pressure of the syntactic foam.

7. A system comprising processing circuitry to determine annular pressure buildup along a wellbore, the processing circuitry performing the method comprising:

(a) analyzing a configuration of the wellbore;

(b) analyzing an effect that at least one of a rupture disk or syntactic foam has on the wellbore; and (c) determining the annular pressure buildup along the wellbore based upon the analysis of step (b).

8. A system as defined in claim 7, wherein step (b) further comprises analyzing the effect that the at least one of the rupture disk or syntactic foam has on a trapped annular pressure or wellhead movement of the wellbore.

9. A system as defined in claim 7, wherein step (a) further comprises:

determining an initial temperature and pressure condition of the wellbore; and determining a final temperature and pressure condition of the wellbore.

10. A computer-implemented method as defined in claim 7, wherein step (a) further comprises analyzing at least one of a drilling temperature or pressure, a production temperature or pressure, a casing stress, or a tubular stress present along the wellbore.

11. A computer-implemented method as defined in claim 7, wherein step (a) further comprises receiving data via a user-interface, the data defining the configuration of the wellbore.

12. A computer-implemented method as defined in claim 11, wherein the data defining the configuration of the wellbore comprises at least one of a number of the rupture disks, a burst rating of the rupture disks, a collapse volume of the syntactic foam, or a crush pressure of the syntactic foam.

13. A non-transitory computer readable medium comprising instructions which, when executed by at least one processor, causes the processor to perform a method comprising:

(a) analyzing a configuration of a wellbore;

(b) analyzing an effect that at least one of a rupture disk or syntactic foam has on the wellbore; and (c) determining an annular pressure buildup along the wellbore based upon the analysis of step (b).

14. A computer readable medium as defined in claim 13, wherein step (b) further comprises analyzing the effect that the at least one of the rupture disk or syntactic foam has on a trapped annular pressure or wellhead movement of the wellbore.

15. A computer readable medium as defined in claim 13, wherein step (a) further comprises:

determining an initial temperature and pressure condition of the wellbore; and determining a final temperature and pressure condition of the wellbore.

16. A computer readable medium as defined in claim 13, wherein step (a) further comprises analyzing at least one of a drilling temperature or pressure, a production temperature or pressure, a casing stress, or a tubular stress present along the wellbore.

17. A computer readable medium as defined in claim 13, wherein step (a) further comprises receiving data via a user-interface, the data defining the configuration of the wellbore.

18. A computer readable medium as defined in claim 17, wherein the data defining the configuration of the wellbore comprises at least one of a number of the rupture disks, a burst rating of the rupture disks, a collapse volume of the syntactic foam, or a crush pressure of the syntactic foam.

19. A computer-implemented method to determine annular pressure buildup of a wellbore, the method comprising determining, using a computer, the annular pressure buildup of the wellbore in response to the presence of at least one of a rupture disk or syntactic foam along the wellbore.

20. A computer-implemented method as defined in claim 19, further comprising the step of determining an effect that the presence of the at least one of the rupture disk or syntactic foam has on a trapped annular pressure or wellhead movement of the wellbore.

21. A computer-implemented method as defined in claim 19, further comprising:

determining an initial temperature and pressure condition of the wellbore; and determining a final temperature and pressure condition of the wellbore.

22. A computer-implemented method as defined in claim 19, further comprising analyzing at least one of a drilling temperature or pressure, a production temperature or pressure, a casing stress, or a tubular stress present along the wellbore.

23. A computer-implemented method as defined in claim 19, further comprising receiving data via a user-interface, the data defining a configuration of the wellbore that is utilized to determine the annular pressure buildup.

24. A computer-implemented method as defined in claim 23, wherein the data defining the configuration of the wellbore comprises at least one of a number of the rupture disks, a burst rating of the rupture disks, a collapse volume of the syntactic foam, or a crush pressure of the syntactic foam.

* * * * *